United States Patent [19]

Smith et al.

[11] 4,333,234

[45] Jun. 8, 1982

[54] PAPER SLITTING DEVICE

[76] Inventors: Dean C. Smith, 2301 Rodney Dr.; Gary F. Quinton, 1261 Skyline Blvd., both of Reno, Nev. 89509

[21] Appl. No.: 188,080

[22] Filed: Sep. 17, 1980

[51] Int. Cl.[3] ..... B26B 27/00

[52] U.S. Cl. ..... 30/2; 30/92

[58] Field of Search ..... 30/112, 111, 2, 90.1, 30/94, 95, 92

[56] References Cited

U.S. PATENT DOCUMENTS

| | | | |
|---|---|---|---|
| 1,105,182 | 7/1914 | Capers | 30/2 |
| 1,646,348 | 10/1927 | Crocker | 30/2 |
| 1,943,956 | 1/1934 | Eisele | 30/2 |
| 2,050,768 | 8/1936 | Seymour | 30/2 |
| 2,098,863 | 11/1937 | Elliott | 30/2 |
| 2,227,421 | 1/1941 | Bjork | 30/2 X |
| 2,645,007 | 7/1953 | Alfredsson | 30/2 |
| 2,869,413 | 1/1959 | Anderson | 30/94 X |

*Primary Examiner*—Jimmy C. Peters
*Attorney, Agent, or Firm*—Herbert C. Schulze

[57] ABSTRACT

This invention is an apparatus for slitting paper, particularly paper wrapped around rolls of coins. The apparatus is characterized by self-centering means to accommodate various sizes of rolls of coins and by the use of a knife blade to sever the rolled end of the wrapper of a roll of coins.

1 Claim, 13 Drawing Figures

FIG. 1.
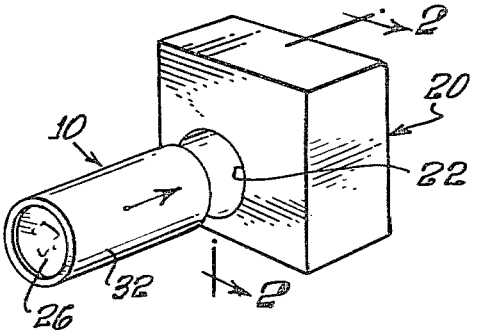
FIG. 4.
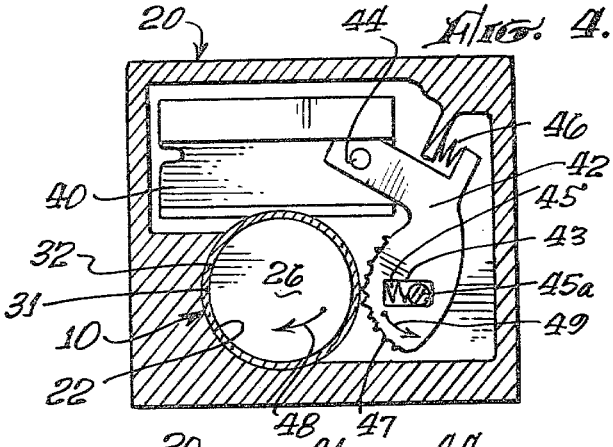
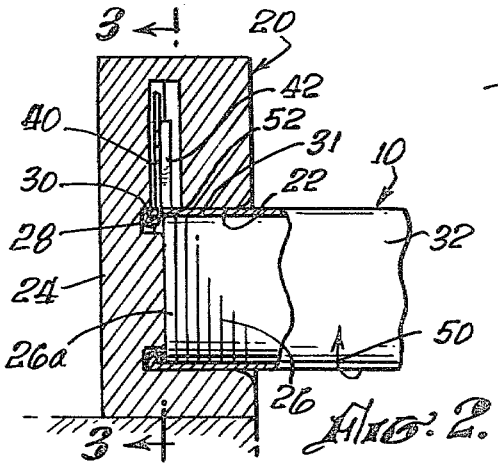
FIG. 2.
FIG. 3.
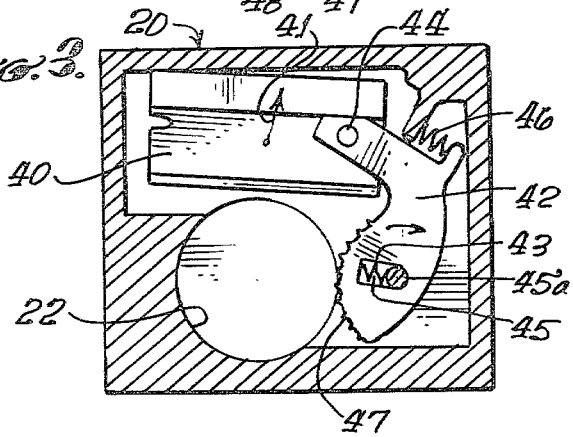
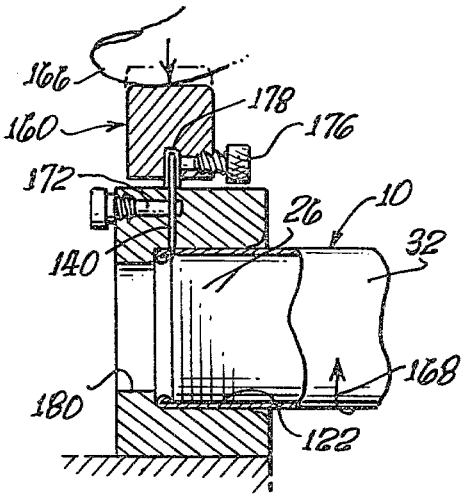
FIG. 5.
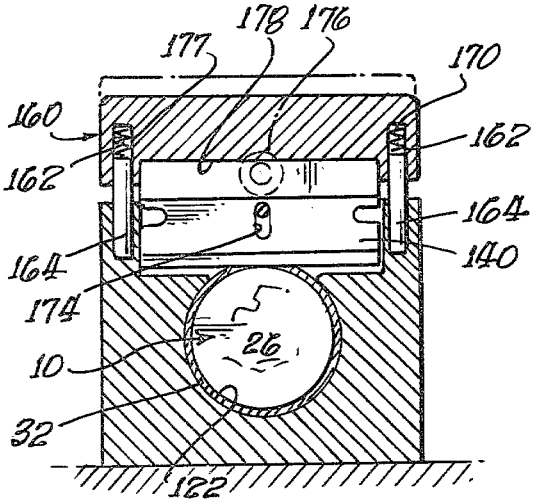
FIG. 6.

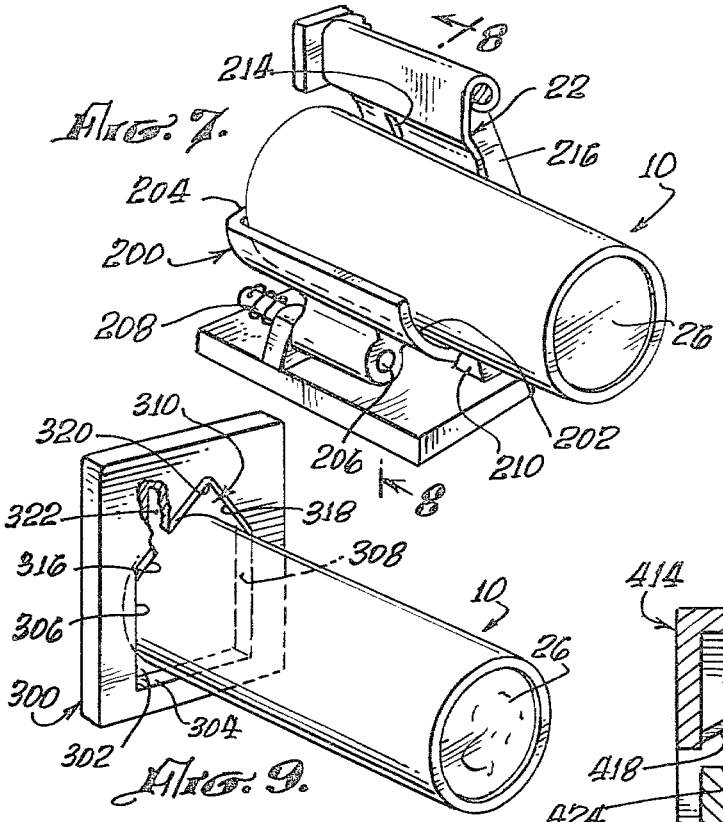
FIG. 7.
FIG. 9.
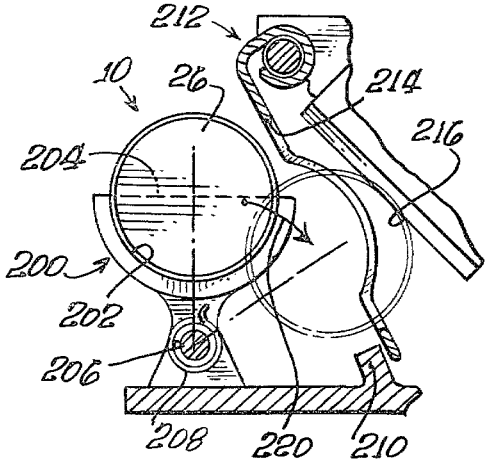
FIG. 8.
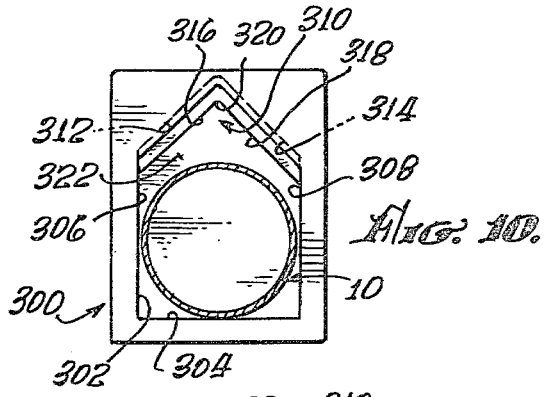
FIG. 10.
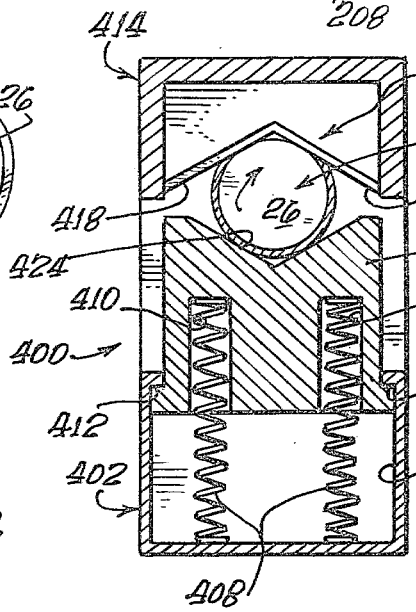
FIG. 12.
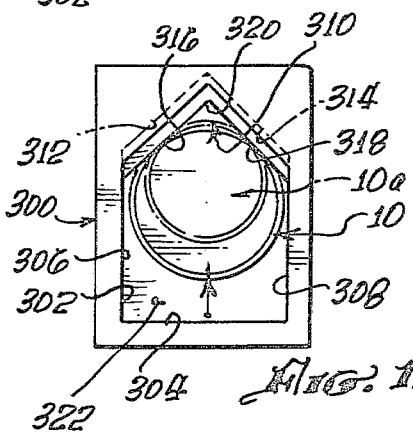
FIG. 11.
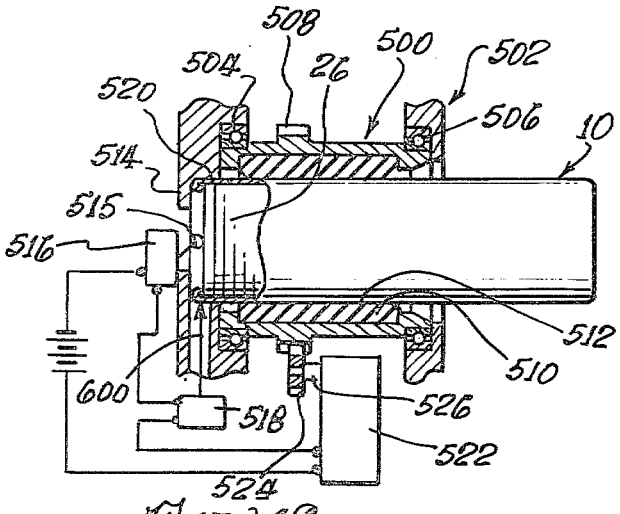
FIG. 13.

PAPER SLITTING DEVICE

CROSS-REFERENCE TO RELATED PATENT APPLICATIONS

This application is unrelated to any other application filed by us except for our concurrently filed patent application entitled COIN WRAPPER REMOVING METHOD AND APPARATUS being filed herewith.

BACKGROUND OF THE INVENTION

1. Field of the Invention

This invention is in the general field of paper cutting apparatus and devices and is more particularly in the field of paper cutting devices designed to slice a portion from the end of a paper apparatus and is even particularly more directed to a device to slice the end from a roll of paper wrapped coins.

2. Description of the Prior Art

To our knowledge, the prior art is quite limited and is limited to the apparatus disclosed in U.S. Pat. No. 3,781,987 In said U.S. Patent, the slicing apparatus is limited to a complex leveraged and connected arrangement which makes for excessive costs of manufacture and excessive maintenance. The present application is directed to a straight forward and simple arrangement to accomplish the end of removing by slicing the rolled end of a roll of coins and is believed to be unique in its simplicity and lack of working parts.

THE SUMMARY OF THE INVENTION

The use of rolls of coins is quite widespread in most retail businesses, services, amusements, and the like. Such coins are customarily provided to merchants and others having use for them, in rolls of given quantities of different coins. The rolls are formed with a paper wrapping about the coins to hold them together and with the ends rolled and tucked in, in such manner that a firm packaging is achieved.

The rolls of coins as presently supplied are quite effective, but they have a common deficiency that it is quite difficult to remove the coins from the wrappers.

Our new device is characterized by the utilization of a single and easily actuated apparatus to cut the rolled ends from a wide variety of sizes of rolls of coins without the necessity of complex mechanisms which are costly to produce and susceptible to mechanical failure.

It is an object of this invention to provide an apparatus for removing the rolled ends of coins having paper wrappings about them, or the like, by the use of a simple and single knife action.

Another object of this invention is to provide such an apparatus as has been described wherein the apparatus is easily serviced.

Another object of this invention is to provide such an apparatus as described wherein the number of working parts involved is held to the absolute minimum.

The foregoing and other objects and advantages of this invention will become apparent to those skilled in the art upon reading a description of a preferred embodiment which follows in conjunction with a review of the appended drawings.

BRIEF DESCRIPTION OF THE DRAWINGS

FIG. 1 is a perspective view showing a roll of wrapped coin being inserted into a paper slitting device of our invention;

FIG. 2 is an enlarged section taken on line 2—2 of FIG. 1;

FIG. 3 is a section taken on line 3—3 of FIG. 2;

FIG. 4 is a view similar to FIG. 3 showing the paper slitting device in another position;

FIG. 5 is a sectional view similar to FIG. 2 but showing an alternate embodiment of slitting the outer edge of a roll of wrapped coins;

FIG. 6 is a section taken on line 6—6 of FIG. 5;

FIG. 7 is an alternate embodiment of a paper slitting device in which the roll of wrapped coins is moved into a slitting tool;

FIG. 8 is a section taken on line 8—8 of FIG. 7;

FIG. 9 is a perspective view of a roll of coins being inserted into a further alternate embodiment of our invention;

FIG. 10 is a side elevation of a device of FIG. 9 showing a roll of coins prior to being inserted into the blade area;

FIG. 11 is a view similar to FIG. 10 showing the roll of coins moved into contact with the blade portion of our invention;

FIG. 12 is an alternate embodiment showing a method in which a variety of sizes of rolls of coins can be placed into a slitting position; and FIG. 13 is a schematic sectional view showing the manner in which a roll of wrapped coins can be inserted into a mechanism of our invention wherein the slitting device is moved into the wrapper portion to be cut and the roll automatically rotated against said slitting device.

DESCRIPTION OF A PREFERRED EMBODIMENT

In the perspective of FIG. 1 a roll of coins 10 is inserted into a slitting device 20 having a cylindrical coin receiving chamber 22.

Within the device 20 is located an end wall 24 against which the outermost coin 26*a* of a number of coins 26 abuts. A cylindrical recess 28 is provided to allow the insertion of the outer rolled bead 30 of the wrapper 32 encasing the roll of coins 26.

In the case of a roll of coins not having the bead 30, the abuttment 24 can be eliminated and the roll of coins can then reach to the bottom of the opening 22.

A slitting tool such as a single edged razor 40 fastened to a control arm member 42 can be moved into contact with the side wall 31 of the wrapper 32. Rotation of the roll 10 into the direction of the arrow 50, shown in FIG. 2, will result in a circumferential slit 52 being formed in the side wall of the coin wrapper. This slit may be formed partially about the circumference of the roll of coins near the end inserted into the unit 20, or it may be completely around the roll of coins separating the portion of the wrapper at the end of the wrapped roll of coins. The arm 42 is fastened at 44 to the blade in any conventional manner and is urged in the direction of arrow 41 by means of a spring 46.

When the wrapped roll of coins 10 is inserted into the recess 22, it is rotated by the handler into the direction of arrow 48 as shown in FIG. 3. This causes the serrated edge 47 of the arm 42 to be moved into the direction of arrow 49 as indicated in FIG. 4. This brings the razor 40 into contact with the side wall of the wrapper. As long as the roll of coins is rotated in the direction of arrow 48 the edge of the razor will be in contact for cutting purposes. As soon as the rotation stops and the roll of coins is withdrawn from the opening 22, the arm 42 will be forced back into its position wherein the razor is withdrawn from its slitting position.

The initial insertion of the roll of coins into the opening 22 allows the wrapper to pass by the serrated portion 47 easily because of an elongated slot 43 which allows a spring 45 to keep the member 42 frictionally in engagement with the wrapped roll of coins 10. A pin 45*a* provides the rotational axis for the arm 42 during its engagement with a moving roll 10 in the direction of arrow 48.

A simplified coin slitting apparatus is shown in FIGS. 5 and 6. In this case, a roll 10 of wrapped coins is inserted into an opening 122 similar to that as shown in FIGS. 1 and 2, and the slitting member 140 is placed into contact for slitting purposes by means of a plunger assembly 160. The plunger 160 has a pair of openings 162 which are mounted on pins 164 affixed to a housing 120 of our alternate embodiment. A suitable recess 166 allows the slitting blade 140 to come in contact with the circumferential edge of the wrapper 32.

While the assembly 160 is being depressed by a finger 166, as shown in FIG. 5, the roll of coins is grasped by the operator and rotated into the direction of arrow 168.

Upon achieving the amount of slitting necessary, the operator then releases the plunger portion 160. Springs 170 placed into the recesses 162 return the member 160 to its uppermost position. A limiting pin 172 mounted in an opening 174 of the razor allow withdrawl of the blade to a limited extent. A threaded knob 176 provides the securement of the razor 140 within a slot 178 of plunger 160. Any left over wrappings from the portion removed from the roll of coins can be easily cleaned out through the opening 180 provided in the end wall 182 of member 120.

FIG. 7 illustrates a spring urged carriage 200 which supports a roll of coins 10 in its arcuate recessed portion 202 and against an end wall 204. The end wall designates a stop means when the roll is placed into the cradle. The cradle is pivoted about a point 206 and moved against spring 208 until it reaches a stop means 210. At this point a slitted safety guard member 212 having a slot 214 for allowing a razor edge 216 to pass therethrough, is pivoted at 218. It can be seen that an operator can place a roll of coins into the cradle, move it in the direction of arrow 220 until it reaches the stopped 210, and then rotating the roll of coins until the desired length of slitting is achieved.

FIGS. 9 through 11 illustrate a further alternate embodiment of our invention in which the wrapped roll of coin 10 is placed into a position as indicated in the perspective of FIG. 9 and then moved in an upward direction as indicated in FIG. 11 to place the outside diameter of the roll of coins at one end into contact with a pair of slitting blades. The mechanism of FIGS. 9 through 11 is shown as a frame 300 having an opening therein of a rectangular shape terminating in a "chevron" configuration. The opening 302 has bottom and two side walls 304, 306 and 308 respectively. At the end opposite the wall 304 is a "V" shaped opening 310 with two converging sides 312 and 314. These sides are sharpened into a knife edge at 316 and 318 terminating at an apex 320. The member 300 has a back wall 322 which acts as a stop for the roll of coins 10.

The blades 316 and 318 are spaced from the back wall 322 a sufficient distance in order to allow for the slitting action to take place at the point behind a bead on the roll of coins, if necessary. In FIG. 11 we have shown two sizes of coins 10 and 10*a*, which may be quarters and dimes, respectively. It can be seen that the converging knife edges can accommodate a number of sizes of coin diameters.

FIG. 12 shows an alternate embodiment in which the slitting assembly 400 comprises a base portion 402 having an opening 404 into which a coin supporting block 406 is placed. Springs 408 placed within cylindrical openings 410 in block 406 keep the block urged upwardly against shoulders 412. Mounted at a spaced distance above the base portion 402 is a slitting assembly 414. Mounted within this assembly is a "chevron"-shaped cutter assembly 416 having sharpened edges 418 and 420 converging to an apex 422.

The block 406 is depressed, a roll of wrapped coins 10 is nested into a "V" shaped cradle 424 and then the roll of coins is moved upwardly by the springs 408 until the roll of wrapped coins is in contact with the blade 418 and 420. The roll of coins is then rotated until the desired length of slit, and the slitting process is accomplished.

FIG. 13 shows an automated version of an alternate embodiment of our invention in which a roll of wrapped coins 10 is inserted into a coin holder 500 being rotatably mounted in a housing 502 by means of bearings 504 and 506 a ring gear 508 is provided on this member 500. A frictional cylindrical member 510 is affixed to the member 500 forming a cylindrical opening 512 for contact with the wrapped roll of coins 10. An end wall 514 is provided on the housing 502 to limit the depth to which the roll of coins can be placed. A contact arm 515 of a micro-switch 516 is placed into position to contact the forward most coin in the wrapped roll of coins 10. This switch actuates a solenoid means 518 which places a slitting device 600 into contact with the outer circumference of the wrapper 520 of the wrapped roll of coins 10.

Simultaneously, a motor 522 having a pinion 524 mounted on an output shaft 526 from the motor, rotatably actuates the gear 508. The receptacle 500, having the wrapped roll of coins frictionally held by its member 510, then rotates the wrapped roll of coins against the slitting device 600 until the length of slit is achieved. At this time, a turn off device, not shown, can stop the rotation of the wrapped roll of coins 10 or the roll of coins withdrawn from the device 500 would automatically disengage the slitting and driving operation.

While we have shown embodiments of this invention and have described the methods that are fully capable of achieving the objects and advantages desired, it is to be understood that such embodiments are for the purpose of illustration only and not for the purpose of limitation.

We claim:

1. A paper slitting device for slitting the side wall of a wrapped roll of coins which comprises: a housing means, said housing means having a cylindrical opening therein terminating in an end wall; a slot in said housing means communicating with said cylindrical opening at a point near said end wall and on a plane normal to a longitudinal axis of said cylindrical opening; a lever means mounted within said slot and said lever means pivotally mounted within said slot at a point parallel to, but offset, from the axis of said cylindrical opening; a semi-circular segment of said lever having a serrated edge means projecting into said cylindrical opening so as to frictionally engage the external cylindrical surface of a roll of wrapped coins; a paper slitting device affixed to said lever means at an end of said lever means so as to be able to come into contact with said external cylindrical surface of said roll of wrapped coins when said roll of wrapped coins is rotated in a direction toward said serrated edge means of said lever and away from said paper slitting device while said wrapped roll is within said cylindrical recess.

* * * * *